US005564445A

United States Patent [19]

Query

[11] Patent Number: 5,564,445

[45] Date of Patent: Oct. 15, 1996

[54] HAIR BRAIDING TOOL

[76] Inventor: Lisa Query, 3901 Ryan St., Lake Charles, La. 70605

[21] Appl. No.: 447,789

[22] Filed: May 23, 1995

[51] Int. Cl.[6] ..... A45D 7/02

[52] U.S. Cl. ..... 132/212; 132/273; 132/247; 132/253; 132/274

[58] Field of Search ..... 132/212, 273, 132/274, 278, 246, 247, 253, 268, 261, 262

[56] References Cited

U.S. PATENT DOCUMENTS

| | | | |
|---|---|---|---|
| D. 33,612 | 11/1900 | Grell . | |
| 50,668 | 4/1917 | Steiner | 132/273 |
| D. 115,534 | 7/1939 | Twomey . | |
| D. 142,711 | 10/1945 | Foster . | |
| 1,025,156 | 5/1912 | Potter . | |
| 1,724,249 | 8/1929 | Baldwin | 132/40 |
| 1,792,032 | 2/1931 | Rayburn | 132/274 |
| 2,490,285 | 12/1949 | Smith | 132/273 |
| 2,547,295 | 4/1951 | Weeks | 132/273 |
| 2,781,045 | 2/1957 | Rösch | 132/7 |
| 2,871,865 | 2/1959 | Anderson | 132/7 |
| 2,889,834 | 6/1959 | Anderson et al. | 132/7 |
| 3,889,692 | 6/1975 | Redrow | 132/7 |

*Primary Examiner*—Gene Mancene
*Assistant Examiner*—Philogene Pedro
*Attorney, Agent, or Firm*—Pravel, Hewitt, Kimball & Krieger

[57] ABSTRACT

A hair braiding tool allows the user to simulate a French braid style hair-do. The apparatus includes an elongated body member comprising a continuous curving web. The body is formed of a plurality of generally C-shaped or horseshoe shaped alternating loops each providing a socket into which a section of hair can be placed when simulating a French braid style hair-do. In a second embodiment, an elongated curved comb like member has first and second sets of opposed teeth. The user simply braids alternating sections of hair into the combs in creating the French braid style hair-do.

11 Claims, 8 Drawing Sheets

HAIR BRAIDING TOOL

BACKGROUND OF THE INVENTION:

1. Field of the Invention

The present invention relates to hair appliances, combs, dressing combs, hair dressing methods and the like. More particularly, the present invention relates to an improved hair braiding tool apparatus that enables the user to create the illusion of a french braid when installed in the user's hair.

2. General Background

The french braid is a very difficult hair style to achieve. Further, only very few individuals are able to create a French braid in their own hair. It is typically easier to French braid another person's hair as the user can visually gauge each step in the process.

Various patents have issued for hair combs, dressing combs, hair dressing devices, and the like. Some of these patent disclose combs with teeth on opposite sides. Some hair combs curve to follow the shape of the users head.

An early patent is the Potter U.S. Pat. No. 1,025,156 entitled "DRESSING COMB". The Potter device provides a comb that employs a handle and a body having teeth projecting from both sides thereof in the same plane and having points in alignment. The handle is straight but has a body of involute form with the minor curve at the end opposite the handle, the body being gradually thickened from the handle outward to reinforce the outer end of the body and stiffen it against any tendency of yielding to freely in use.

The Baldwin U.S. Pat. No. 1,724,249 entitled "MARCEL HAIR WAVER" provides and apparatus consisting of an elongated body member having soft resilient material and having finger extending for opposite sides thereof, the fingers on each side being spaced from one another and the body member extending beyond the fingers. The apparatus is reduced in size adjacent its ends to facilitate the attachment of a retaining device such as a rubber band.

The Rosch U.S. Pat. No. 2,781,045 entitled "METHOD AND APPARATUS FOR WAVING HAIR" discloses an apparatus for treating human hair for obtaining permanent waves and curls. The apparatus comprises a cylindrical-rod like body member provided with two diametrically opposite rows of teeth or spines disposed in comb like fashion. The hair is placed between and wound around the body. The free end of the hair is held by a clamping bar member of arcuate cross section. One end of the bar is pivotally attached to the corresponding end of the body while, the other end is initially held against the body by pressure exerted between the index finger and the thumb. This clamps the free end of a lock of hair after the first turn of the body.

U.S. Pat. No. 2,871,865 issued to E. D. Anderson is entitled "HAIR CURLING DEVICE AND METHOD". The Anderson patent discloses a device for preparing and setting curls of the hair which is dry or wet with water or waving solution, for which is otherwise being set permanently or semi-permanently so that the use of bobby pins or other means of fastening the hair is not required. The apparatus includes a web like, elongated device for curling and setting hair in the presence of fluid. The apparatus includes a spiral forming means and a reticulate member. The spiral forming means causes the device to assume a natural closed spiral form when it rests and to return resiliently to the closed spiral form when the device has been forcibly opened to assume an unnatural extended form and then has been released. The spiral forming means is substantially co-extensive with the device and with the reticulate member permitting passage of fluid to and from the hair. A similar device and method for curling and setting the hair is seen in the Anderson U.S. Pat. No. 2,889,834.

The Redrow U.S. Pat. No. 3,889,692 discloses a hair dressing method and device. The apparatus produces a simulated braid pattern in long hair by separating a given mass of hair into individual strands for delivery into and through a plurality of individual generally tubular flexible guide means that have previously been disposed in an intertwined relationship. The guide means are then adapted to be individually removed end wise over the free ends of the strands which have been drawn into the respective guide means to leave each strand of hair in the intertwined relationship of the formerly intertwined (not removed) guide means.

SUMMARY OF THE INVENTION

The present invention provides an improved hair braiding tool that enables the user to create the illusion of a French braid when properly installed in the hair of the user.

The apparatus of the present invention allows an individual to create a style similar to the French braid in ones own hair within a very short period of time, typically just a number of seconds.

The apparatus of the present invention allows a user to create a style similar to the French braid even though the user has absolutely no knowledge of how to french braid a persons hair.

The present invention provides the user with a hair style result that is elegant, sophisticated and stylish. The user eliminates consulting complicated "how-to books", avoiding prolonged procedures that are usually required to properly create a French braid hair style.

The hair braiding tool apparatus of the present invention includes an elongated curved hair piece that tracks the shape of the users head. The apparatus is placed at a position just above the base of the cervical spine and along a path that terminates at the users crown.

The apparatus of the present invention provides a hair braiding tool appliance or apparatus that when installed stands out slightly from the user's head. When hair is secured around the comb it appears thicker than the actual braid secured to the hair.

In use, the hair braiding tool of the present invention is placed along the center line of the rear of the person's head. The user gathers a small section of hair and brings that section of hair toward the back of the head and over the tool appliance. The user then tucks the first section of hair under the tool. This process is repeated with small sections of hair sequentially from opposing sides of the user's head. The user continues alternation from side to side until all of the hair is secured within the twister apparatus, all of its loops sockets being filled with hair.

Remaining hair can be wrapped around the bottom of the apparatus. Hair may be braided to the tool until all hair is secured, then fastened at the lower end.

The present invention provides two embodiments. In a first, preferred embodiment, a gradually curving continuous member is provided that tracks a curving snaking path. A plurality of horseshoe shaped sockets are defined by the curving path. Each of these alternating horseshoe shaped sockets receive sections of the user's hair when a French braid is to be simulated. An oval loop is provided at the top end portion of the apparatus. A transverse bar or strut is placed at the end bottom portion of the apparatus. The bar serves the purpose of an anchor in the first embodiment. However, the transverse bar can be attached to the loop to place the device in a generally cylindrical shape for use with hair styles such as the Bun and the Halo.

In a second, alternate embodiment, an elongated hair styling piece includes an elongated body portion that includes a straight section and a curved section. The curved section and straight section are contiguous and integral. A plurality of teeth, (each generally cylindrical in shape and having hemispherical ends) are positioned at regular intervals along the body portion. Spaced slightly away from this plurality of teeth and at one extreme end portion of the body is a anchor. The anchor end of the apparatus defines the lower end portion that is placed just above the users cervical spine.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 4 is a top view of the preferred embodiment of the apparatus of the present invention;

DETAILED DESCRIPTION OF THE PREFERRED EMBODIMENT

Figures 1, 2, 3, 5:
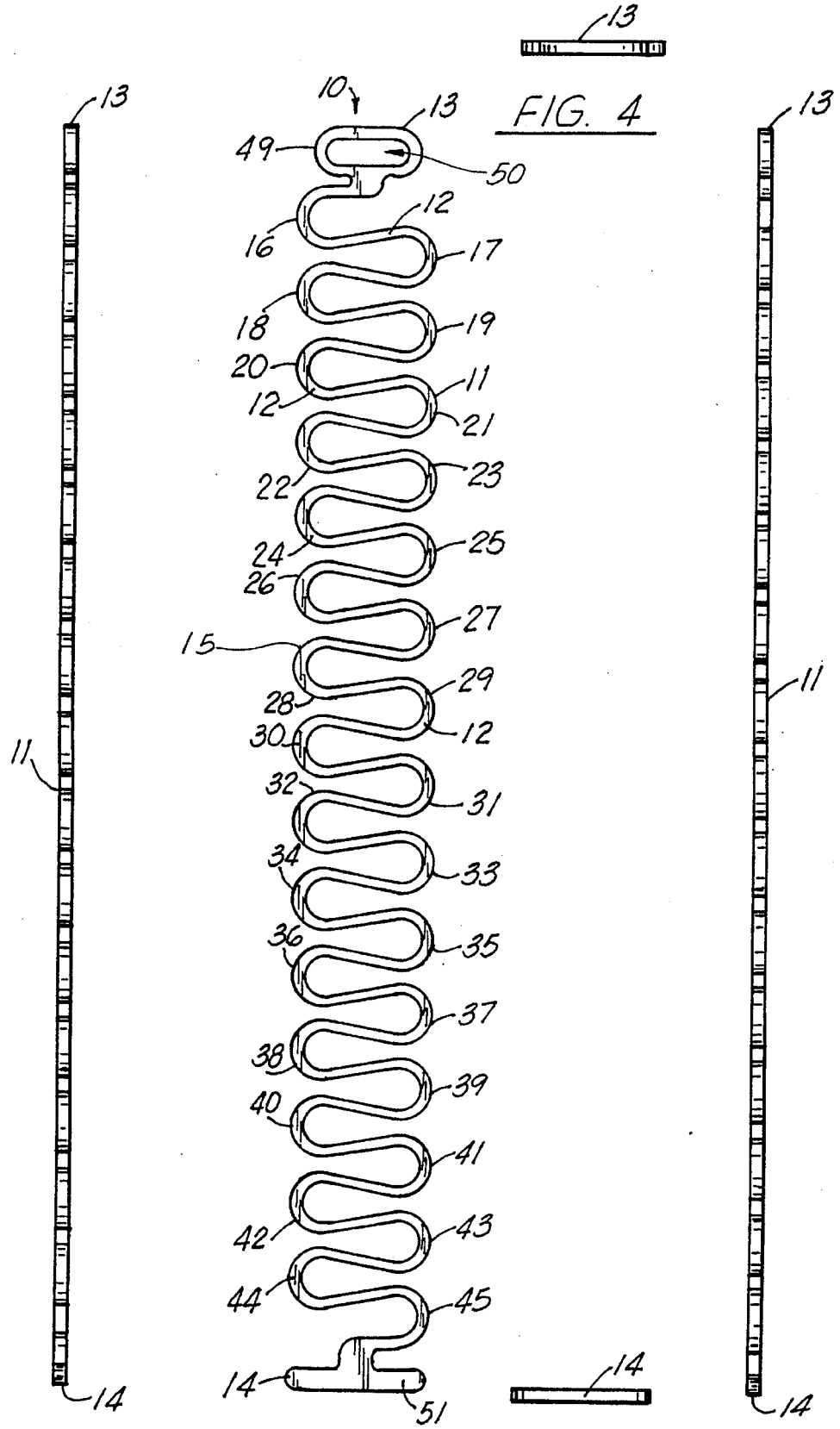
FIG. 1 is a top view of the preferred embodiment of the apparatus of the present invention.
FIG. 2 is a left side of the preferred embodiment of the apparatus of the present invention.
FIG. 3 is a right side view of the preferred embodiment of the apparatus of the present invention.
FIG. 5 is bottom view of the preferred embodiment of the apparatus of the present invention.

FIGS. 1–5 show generally the preferred embodiment of the apparatus of the present invention designated generally by the numeral 10. Hair braiding tool 10 is in the form of an elongated body member 11 formed of a continuous curving web 12 of preferably plastic or metallic flexible material. The body 11 portion has a first end portion 13 and a second end portion 14. A middle 15 portion of the body member 11 forms a plurality of between about 20 and 40 loops.

A first loop 16 is placed adjacent end portion 13. A final loop 45 is placed adjacent end portion 14. Each of the remaining intermediate loops 17–44 is generally horseshoe shaped. The structure of a particular loop (such as the loop 17 shown in FIG. 6) includes a semi-circular shaped section 46 and a pair of straight legs 47, 48. The leg 47 of loop 17 is common to the loops 16 and 17 as shown. Similarly, the leg 48 forms a part of the loops 17 and 18. An oval shaped closed loop 49 having an opening 50 is provided at upper end 13. A transverse linear bar or strut 51 forms the lower end 14 as shown in FIG. 1. The strut 51 can fit through the opening 50 of loop 49 when the apparatus 10 is to assembled into a cylindrical shape (see FIG. 18). This cylindrical configuration is used to form a number of hair designs such as for example the "Halo", "Bun", or the like.

Figure 6:
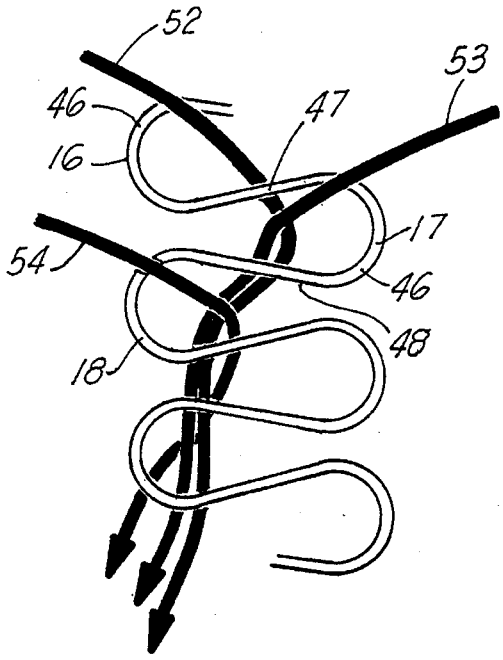
FIG. 6 is a fragmentary schematic view illustrating the placement of alternating sections of hair through the alternating sockets of the apparatus.

In FIG. 6 and in FIGS. 9–12, arrows 52–54 are used to illustrate the placement of sections of the users hair through alternate descending order loops. In order to form a French braid, the user first selects a section of hair from the top left side of the user's head and places that section of hair through the uppermost loop 16. This covers the upper end 13 of the apparatus 10 with the user's hair. The arrow 52 schematically illustrates the placement of the first section of hair into the loop 16 wherein it occupies a position adjacent the semi-circular 46 portion of loop 16. That first section of hair is then tucked between the user's head and the body member 11. A second arrow 53 schematically illustrates the placement of a second section of hair into the next, and adjacent loop 17. The arrow 53 represents hair taken from the right top side of the user's head. The arrow 54 represents a third section of hair taken from the left side of the user's head. This third section of hair is positioned just below the first selected section of hair, represented schemattically as the arrow 52. This pattern of alternating sections of hair (each section slightly lower than the previous one selected) from left and right sides of the user's head repeats until the hair braiding tool 10 is covered with alternating strands of hair to give a look of the French braid hair style (see FIGS. 7–8).

In forming a French braid design, the user selects sections of hair approximately one to one and a half (1-1½") inches in thickness beginning at the top of the user's head on one side and sequentially taking sections of hair from opposite sides of the user's head and in gradually descending elevational positions down the user's head. Each section of hair is inserted into a loop that opens away from the side of the head from which the section of hair is selected.

Figure 7:
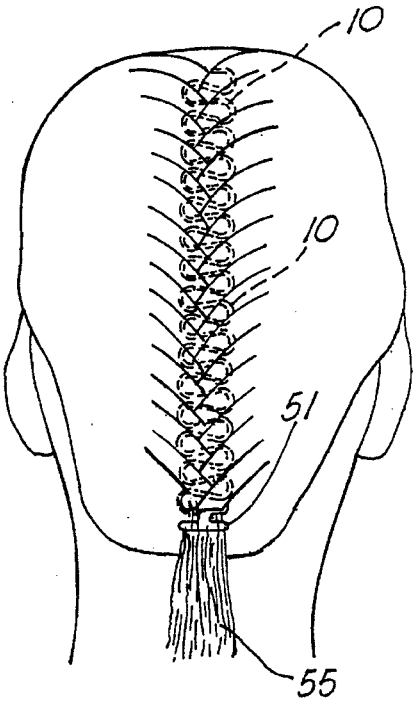
FIG. 7 is a schematic view illustrating a French braid hair design using the apparatus of the present invention.
Figure 8:
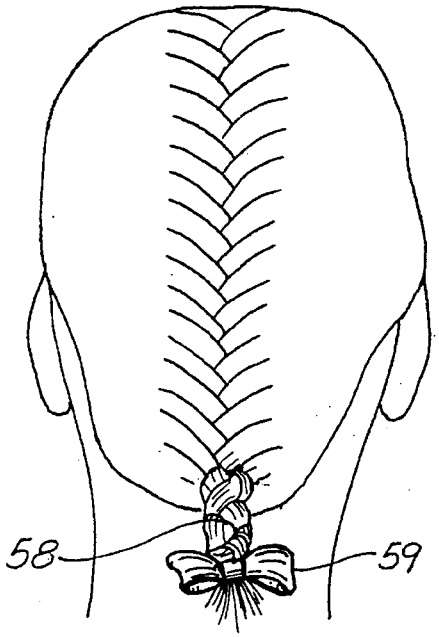
FIG. 8 is another schematic view illustrating a French braid style hair-do made in accordance with the method and apparatus of the present invention.
Figure 9:
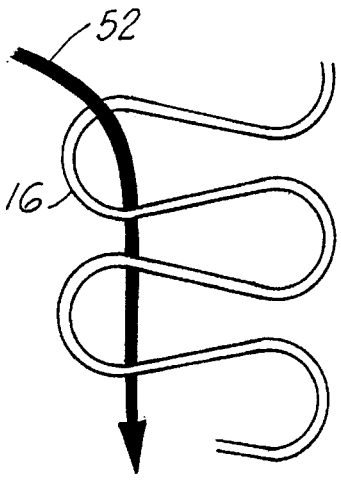
FIG. 9 is a fragmentary view illustrating the placement of an initial section of the user's hair through a first loop of the hair braiding tool of the present invention.
Figure 10:
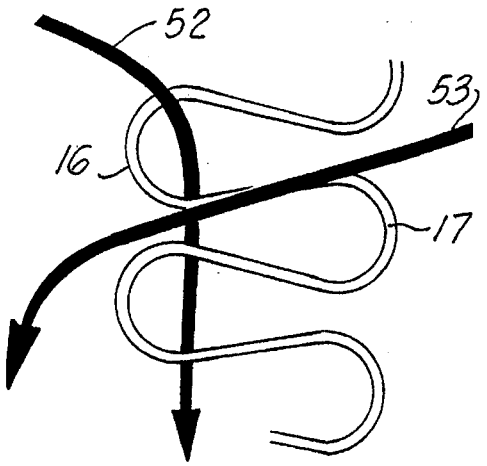
FIG. 10 is a further schematic view illustrating placement of the first and second sections of hair through the first and section loops of the hair braiding tool of the present invention.

The final design is shown in FIG. 7 wherein the apparatus 10 of the present invention has been completely covered with a plurality of alternating sections of the user's hair. The bottom of the hair can be and tied with a rubber band for example to the bottom transverse strut member 51. The remaining hair designated as 55 in FIG. 7 can also be braided as shown to form a braided end portion 58, covered with a bow 59, as an example. FIGS. 9–12 further illustrates the sequential placement of strands of hair. In FIG. 9, the first arrow 52 is placed through the loops 16. In FIG. 10, a strand of hair from the right side of the user's head is placed through the loop 17.

Figure 11:
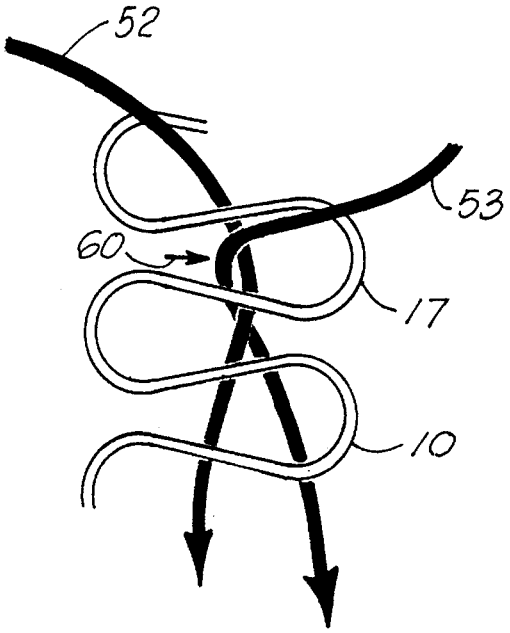
FIGS. 11 and 12 show the placement of second and third sections of hair through the first, second and third loops of the hair braiding tool of the present invention.
Figure 12:
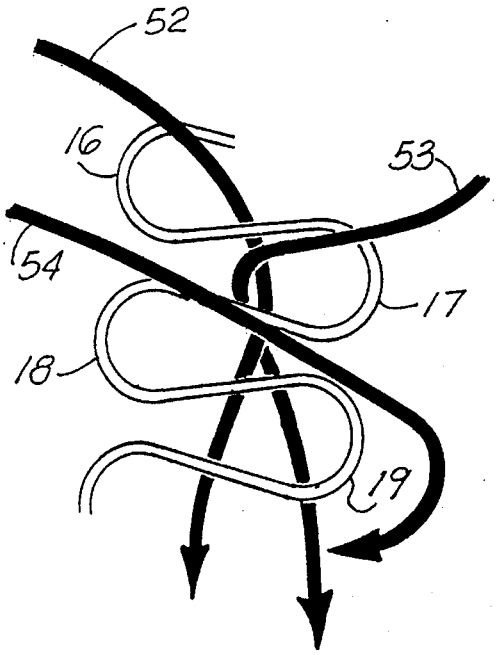

In FIG. 11, the arrow 53 shows that the second strand of hair is pulled into the open end of loop 17 as shown by the arrow 60. The second strand of hair illustrated by the arrow 53 then is placed under the body member 11, between the body member 11 and the user's head as shown. Each strand of hair schematically illustrated by the arrows 52–54 in FIGS. 9–12 is placed in a sequentially lower loop such as 16, 17, 18, 19, etc.

Figure 13:
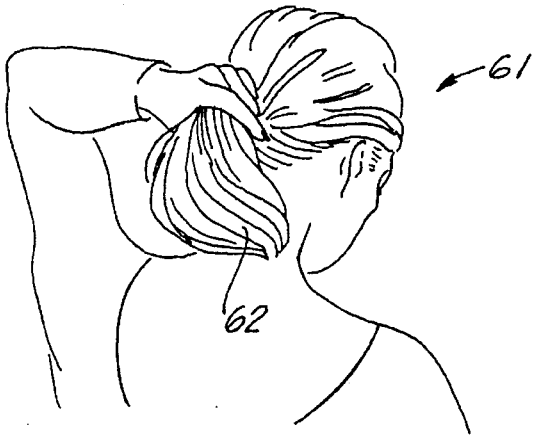
FIGS. 13–15 are schematic view illustrating the placement of the hair braiding tool in the user's hair to form a Bun or Halo style.
Figure 14:
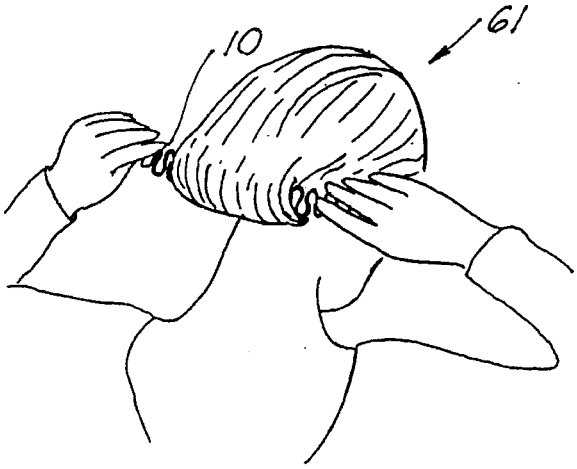
Figure 15:
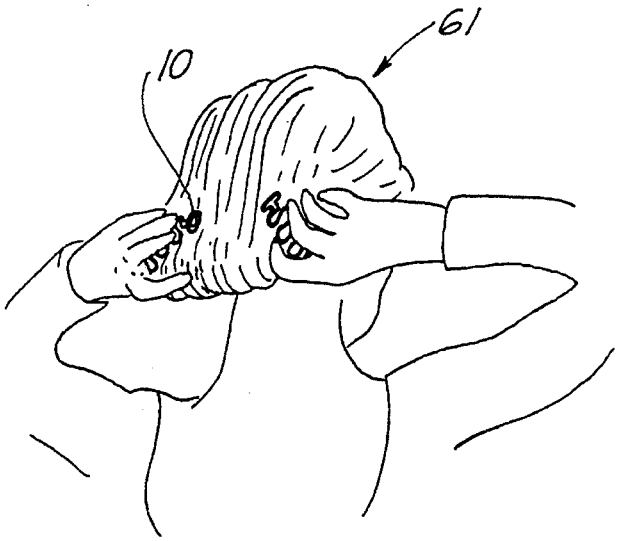
Figure 16:
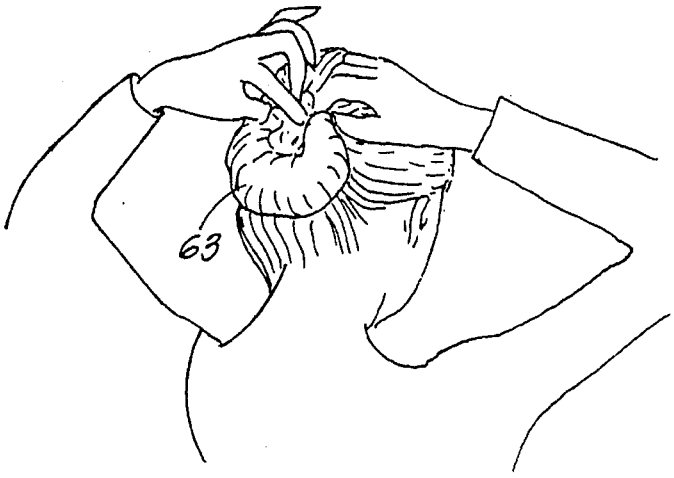
FIGS. 16–17 further illustration sequential steps used to form a Bun or Halo hair style using the apparatus of the present invention.
Figure 17:
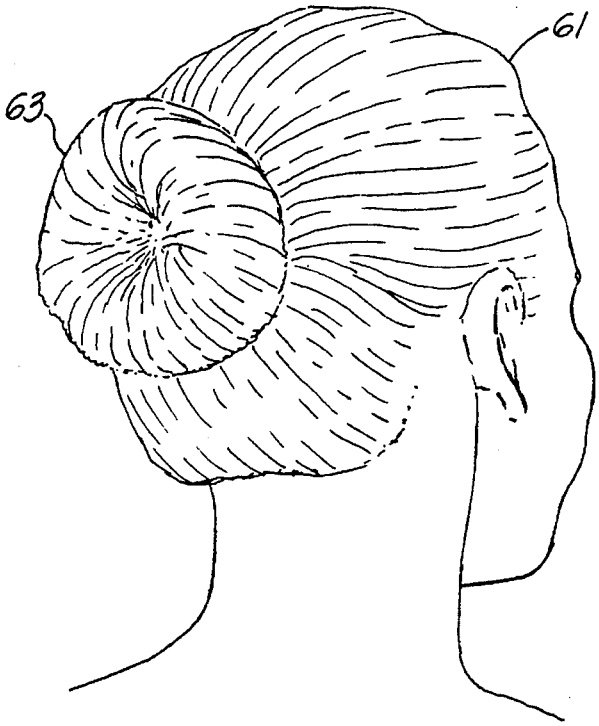
Figure 18:
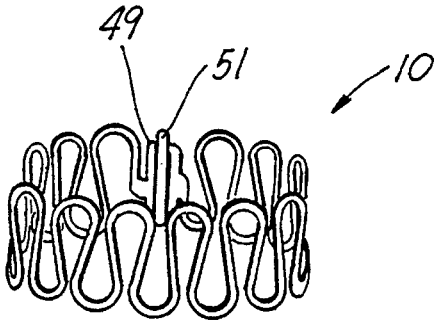
FIG. 18 shows the apparatus of the present invention in a cylindrical shape formed by joining the ends together for use in creating various hair styles.
Figure 19:
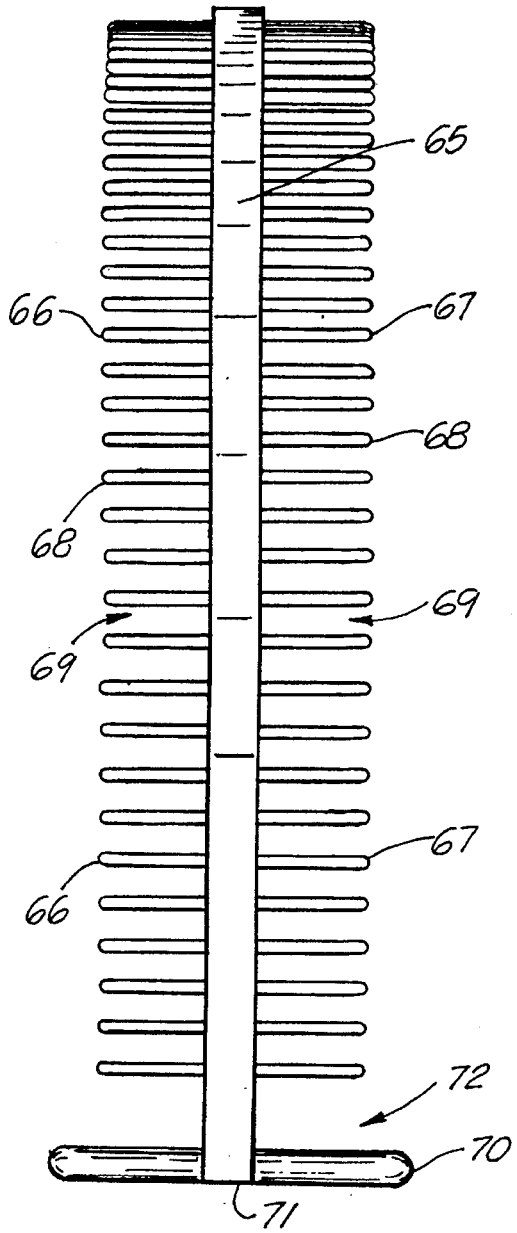
FIG. 19 is a front view of an alternate embodiment of the apparatus of the present invention.
Figure 20:
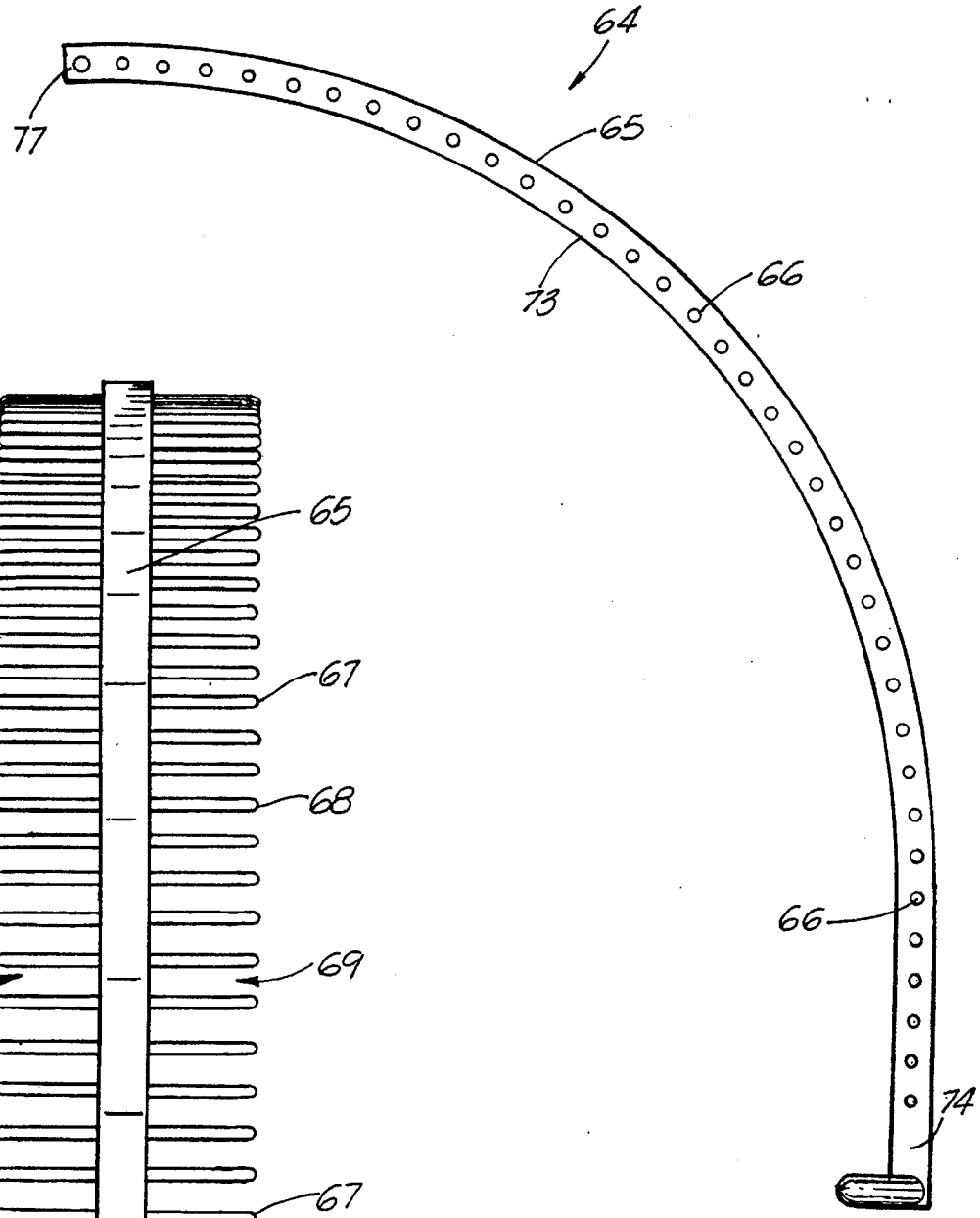
FIG. 20 is a side view of the alternate embodiment of the apparatus of the present invention.

In FIGS. 13–15, a user 61 is shown forming a "Bun" or "Halo" style design. The "Halo" design is typically the same as the "Bun" design shown in FIGS. 13–17. However, the "Halo" style simply places a rounded bun structure higher on the user's head. In FIG. 13, the user grabs the hair and holds it into a ponytail designated as 62. In FIGS. 14–15, the user takes the apparatus 10 and rolls the hair from the ponytail toward the head as shown. The apparatus 10 is then placed in the cylindrical position shown in FIG. 18 wherein transverse bar 51 is inserted through opening 50 of oval loop 49. This joins the ends 13, 14 together so that the apparatus 10 assumes a cylindrical position as shown in FIG. 18. The Halo or Bun is designated as 63 in FIGS. 16 and 17.

In FIGS. 19–24, an alternate embodiment is shown, designated generally by the numeral 64. Hair braiding implement 64 includes an elongated longitudinal strut 65 having a plurality of left and right teeth 66, 67 thereon as shown. The teeth 66, 67 are each cylindrically shaped having a hemispherical end portion designated as 68. A space 69 is placed between each adjacent tooth 66 or 67. An anchor 70 is placed at the lower end 71 of the apparatus 64. The anchor 70 is spaced a greater distance from the teeth 66, 67 then the spacing between the adjacent teeth as shown. The recess 72 in FIG. 19 indicates the distance between anchor 70 and teeth 66, 67.

Figure 22:
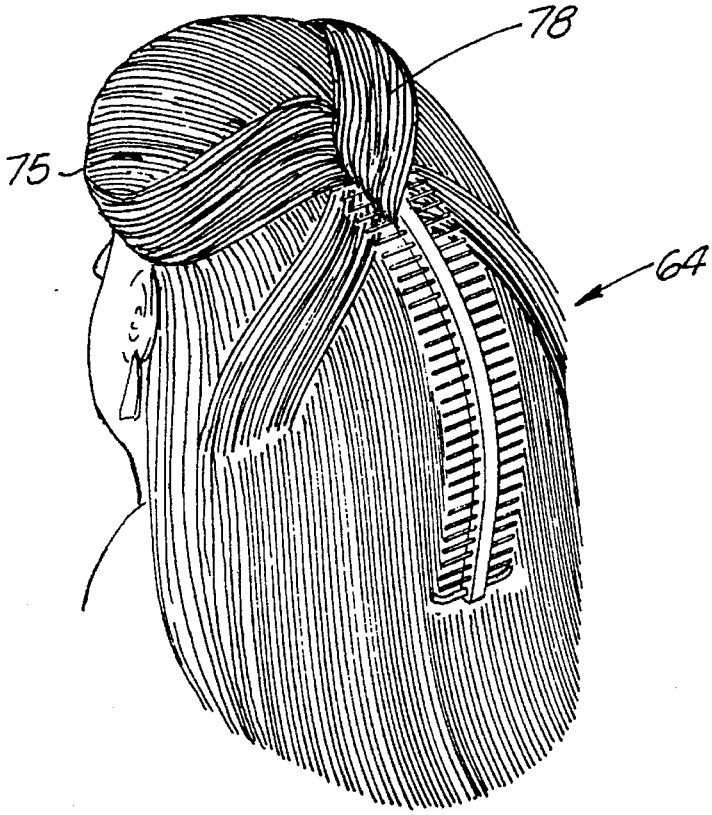
Figure 23:
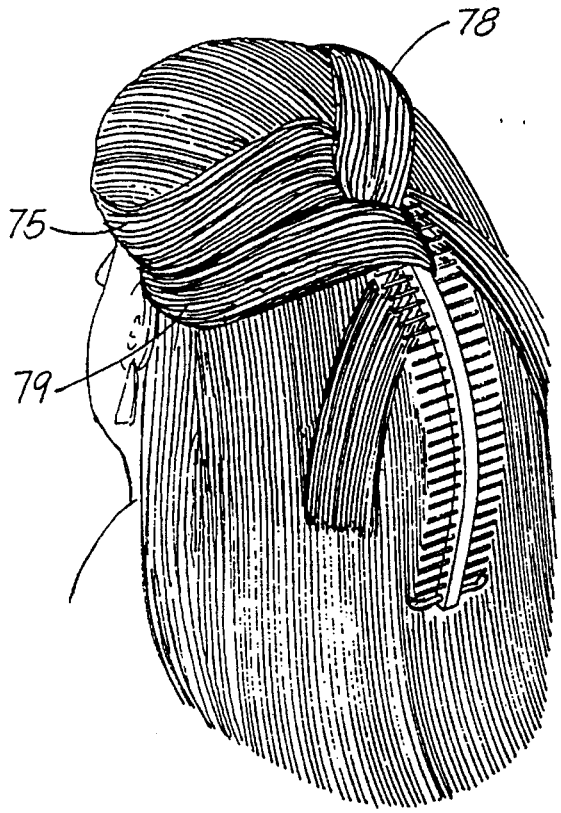
Figure 24:
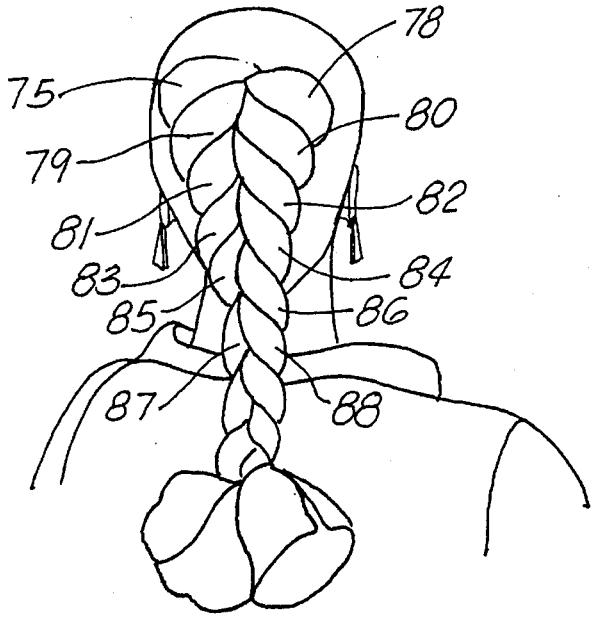

The apparatus 64 includes a curved section 73 and a straight section 74. This allows the apparatus 64 to track generally the shape of the user's head as shown in FIGS. 22–24.

Figure 21:
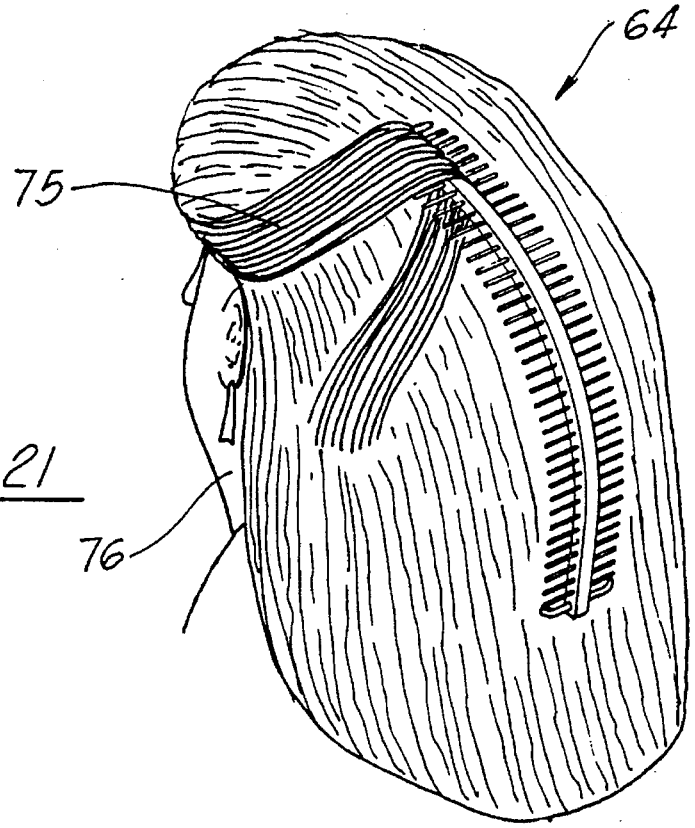
FIGS. 21–24 are sequential view illustrating the formation of a French braid type hair style using the second embodiment of the apparatus of the present invention.

As with the preferred embodiment of FIGS. 1–18, the alternate embodiment 64 can be used to form a French braid style hair-do. In FIG. 21, a first section of the user's hair designated as 75 is draped over the apparatus 64. The section of hair 75 is taken from the left side of the user's head 76 as with the preferred embodiment, this initial section of hair 75 is taken just above the user's ear and is used to cover the top portion 77. A second section hair 78 is placed over a plurality of the left teeth 66 as shown in FIG. 22 and any position below the first section 75 as shown. In FIG. 23, a third section 79 is shown being taken from the left side of the user's head, engaging the right set of teeth 67 and being placed under the section hair 78 as shown. In this fashion, the user alternates sections of hair from the left and right sides of the head, each section of hair being placed on the teeth opposite the side of the user's head from which the section of hair is obtained. In FIG. 24, the sections are indicated by the numerals 75 and 79–88 to complete the French braid style hair design of the present invention.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A hair braiding tool apparatus comprising:

a) a body member that includes a continuous curving web portion, the body having first and second free end portions and a middle portion;

b) the middle portion of the body member forming a plurality of between about twenty and forty (20–40) loops, each loop being sized and shaped to receive a lock of hair of the user when forming a French braid type hair style;

c) the loops being defined by a section of the web that includes a generally semicircular portion and a pair of legs attached to opposite sides of the semicircular portion;

d) the loops being widest at a position adjacent to the semicircular section for holding said locks of hair at the said widest portion of the loops;

e) a closed loop being attached to the first end portion of the body member;

f) a transverse bar being attached to the second end portion of the body member;

g) the transverse bar and closed loop being connectable when the body member assumes a generally circular configuration.

2. The hair braiding tool apparatus of claim 1 wherein the body member has a length and a width, and the length is many times the dimension of the width.

3. The hair braiding tool apparatus of claim 1 wherein the body member has a length of between about eight and ten (8–10) inches.

4. The hair braiding tool apparatus of claim 1 wherein the web has transverse cross section that is much smaller than the overall width of the body member.

5. The hair braiding tool apparatus of claim 1 wherein the ratio of length to width is at least 4:1.

6. The hair braiding tool apparatus of claim 1 wherein the ratio of length to width is about 10:1.

7. The hair braiding tool apparatus of claim 1 wherein the loops are each horseshoe shaped.

8. The hair braiding tool apparatus of claim 1 wherein adjacent loops face in opposite directions.

9. The hair braiding tool apparatus of claim 1 wherein the loops are each horseshoe shaped and adjacent loops face in opposite directions.

10. The hair braiding tool apparatus of claim 1 wherein the body member has a longitudinal axis, and each loop is symmetrically positioned about a line that is perpendicular to the longitudinal axis, and adjacent loops face in opposite directions.

11. A hair braiding tool apparatus comprising:

a) a body member that includes a web portion, the body having a longitudinal axis, first and second free end portions and a middle portion;

b) the middle portion of the body member forming a plurality of between about twenty and forty (20–40) loops, each loop being sized and shaped to receive a lock of hair of the user when forming a French braid type hair style;

c) each of the loops being defined by a section of said web that includes a generally semicircular portion and a pair of struts attached to opposite sides of the semicircular portion, each of the legs extending transversely with respect to the longitudinal axis;

d) each of the loops being widest at a position adjacent to the semicircular section so that the loops can hold alternating locks of a user's hair when forming a French braid hair design.

* * * * *